US005580010A

United States Patent [19]

Barclay et al.

[11] Patent Number: 5,580,010

[45] Date of Patent: Dec. 3, 1996

[54] CUTTING SEGMENTS WITH INTERLOCK KEY ASSEMBLY FOR A ROTARY SHEARING WHEEL

[76] Inventors: Randel L. Barclay, 5616 Carpenter Rd.; Mark T. Diemunsch, 3164 Loomis Ave., both of Stockton, Calif. 95205

[21] Appl. No.: 419,720

[22] Filed: Apr. 10, 1995

[51] Int. Cl.[6] ..... B02C 4/08; B02C 18/18

[52] U.S. Cl. ..... 241/236; 241/294; 83/673

[58] Field of Search ..... 241/235, 236, 241/294, 295; 83/500, 673

[56] References Cited

U.S. PATENT DOCUMENTS

| | | | |
|---|---|---|---|
| 3,931,935 | 1/1976 | Holman | 241/24 |
| 3,991,944 | 11/1976 | Baikoff | 241/36 |
| 4,374,573 | 2/1983 | Rouse et al. | 241/101.7 |
| 4,607,800 | 8/1986 | Barclay | 241/159 |
| 4,776,249 | 10/1988 | Barclay | 83/673 |
| 4,901,929 | 2/1990 | Barclay | 241/236 |
| 5,144,874 | 9/1992 | Garrett | 83/332 |
| 5,145,120 | 9/1992 | Barclay | 241/286 |
| 5,152,469 | 10/1992 | Dicky | 241/236 |
| 5,318,231 | 6/1994 | Bernhardt et al. | 241/236 |

*Primary Examiner*—John M. Husar
*Attorney, Agent, or Firm*—Thomas Schneck

[57] ABSTRACT

A shearing wheel, and a method of assembling the same, having individually demountable cutting segments, shear knives, and an interlock key assembly to wedge adjacent shear knives together so that each shear knife shares a mounting force of the attachment bolts present on adjacent knives. The shear knives are mounted in successive abutting relation, forming a chevron-shaped aperture into which a rectangular key is wedged. A portion of each shear knife extends radially beyond the annular member. This extending portion forms a toothlike structure for feeding and ripping waste material. A support shoulder extending axially from the annular member contacts and supports the shear knives. The shear knives may be individually removed and resharpened, whereafter shims are positioned between the shear knives and the annular member to properly space the shear knives from an adjacent shearing wheel.

20 Claims, 5 Drawing Sheets

CUTTING SEGMENTS WITH INTERLOCK KEY ASSEMBLY FOR A ROTARY SHEARING WHEEL

TECHNICAL FIELD

The present invention pertains to an apparatus for shearing tires into segments. Specifically, the present invention pertains to shear knives for a rotary shearing wheel.

BACKGROUND ART

The problem of disposing of bulky waste materials is receiving increasing attention as existing landfills reach capacity and the availability of additional land for waste disposal decreases. Reducing waste, such as tires, in size permits volume densification and reduces the requirements of subsequent processing.

Shredder machines which utilize paired shearing wheels to shred waste material into smaller pieces have been developed. The term "shredder" as used herein means a machine which reduces objects by shearing action. For example, U.S. Pat. Nos. 5,145,120, 4,901,929 and 4,607,800 to Barclay disclose shredders in which rotating shearing wheels overlap at the edges of cutting segments, or shear knives, on the wheels to cut into the waste material like giant knives. Other patents teaching this type of machine include U.S. Pat. No. 4,374,573 to Rouse et al., U.S. Pat. No. 3,991,944 to Baikoff and U.S. Pat. No. 3,931,935 to Holman. The aforementioned machines are "primary" shredders in the sense that whole tires may be fed into the machines for shredding.

One problem faced by the aforementioned shredders is the relatively short operational life of the shear knives, due to the arduous nature of shearing waste material, e.g., tires. The wear caused by shearing reduces the edge of the shear knives, requiring periodic replacement of the blades. One approach to decreasing the periodicity of replacing the knives is to form them from exotic alloys. In this manner, the operational life of the knives are increased in that the knives hold a sharp edge for a greater period of time. This is typically unfeasible commercially, as the alloys employed are very expensive.

Another approach is to provide demountable shear knives that may be periodically resharpened. The above-cited patent to Rouse et al. teaches a shredder having paired shearing wheels with overlapping resharpenable shear knives along a periphery of each shearing wheel. However, the resharpening requires removal of material along the overlapping adjacent edges, so that the clearance between the edges is affected. This reduces the effectiveness of the shredder because the clearance between overlapping adjacent edges of the shear knives of the two shearing wheels must remain within a relatively small range. Consequently, the shear knives in Rouse et al. must be replaced regularly.

The above-cited U.S. Pat. No. 4,901,929 to Barclay overcomes the problem encountered by Rouse et al. by providing shims between an annular member and shear knives attached thereto. Each shear member has a radially outward end that is comprised of a center annular member extending from a hub and sandwiched between two resharpenable shear knives. To overcome the loss of material due to resharpening, a shim is placed between the center annular member and the resharpened shear knife. In this manner, the clearance between adjacent shear knives is maintained. However, Barclay '929 has demonstrated undue clearance in the knife due to degeneration of the shim or annular member.

It is an object, therefore, of the present invention to provide a shear knife for a rotary shearing wheel that has an longer operational life than the shear knives of the prior art.

SUMMARY OF THE INVENTION

This object has been achieved by a shearing wheel with individually demountable cutting segments, shear knives, and an interlock key assembly to wedge adjacent shear knives together. Each shear knife has opposed inner and outer major surfaces separated by opposing leading and trailing edges, the leading and trailing edges separating a radially outward facing upper surface and a radially inward facing lower surface, the inner major surface mounted facing the first side face. A first rectangular slot defines an opening proximate to the leading edge and extends inwardly and downwardly therefrom towards the radially inward facing surface. A second slot defines an opening proximate to the trailing edge and extends inwardly and downwardly therefrom towards the radially inward facing surface. The opening of the first slot aligns with the opening of the second slot on adjacently mounted shear knives, with the first and second slots defining a chevron-shaped aperture. The chevron-shaped aperture defines the housing of the interlock key assembly. The key is a cube of malleable material that fits into the chevron-shaped aperture, causing a radially downward bending force and wedging adjacent shear knives together.

The shearing wheel has a predetermined number of uniform shear knives mounted and arranged around a first side face of an annular member. The shear knives are arranged to successively abut one another so that a portion of each shear knife extends radially beyond the annular member. In a preferred embodiment, the radially outward facing upper surface is planar, defining a top of the shear knife, and the trailing edge defines a right angled end. Opposite to the right angled end is the leading edge defining an acutely angled end whose angle depends on the number of shear knives to be mounted to the annular member. Opposite to the top is the radially inward facing lower surface, defining a spherically curved bottom surface of the shear knife. When the predetermined number of shear knives are laid right angled end to acutely angled end, the bottom surfaces form a circle defining a registered diameter. In this fashion, the acutely angled ends extend radially outward from the abutting right angled ends to form teeth. The teeth serve to feed material into the pinch points of counter-rotating shearing wheels.

The shear knives are positioned with a major surface mounted to a first side face of the annular member via bolts, which penetrate the annular member and engage threaded holes in the shear knives. Each shear knife has a major surface opposite to the one mounted to the side face, that forms a shearing edge. The shearing edges of one wheel may be placed in shearing cooperation with a counter-rotating shearing wheel. The shearing knives may be demounted and the surface ground flat to obtain a sharp shearing edge. Shims placed between the shear knives and the annular member may be used to position the shear knives members in proper shearing relation.

Optionally, the first side face of the annular member includes a support shoulder that extends axially outward for contacting the radially inward facing surface of the shear knives, which form the registered diameter. The support shoulder should have an axial extent that is less than the width of the shear knives so that the shearing edges of the shear knives extend axially beyond the support shoulder.

Further, the annular member may include a second side face and associated support shoulder. Shear knives, as previously described, may be mounted to the second side face slightly rotationally offset from the shear members mounted to the first side face, although this is not critical.

In addition to removable shear knives, the shearing wheel may include optional removable wear plates. These wear plates may be mounted on the sides and circumferential periphery of the wheel to provide further protection to the wheel and an inexpensive means for repairing damaged wheels.

BEST MODE FOR CARRYING OUT THE INVENTION

Figure 1:
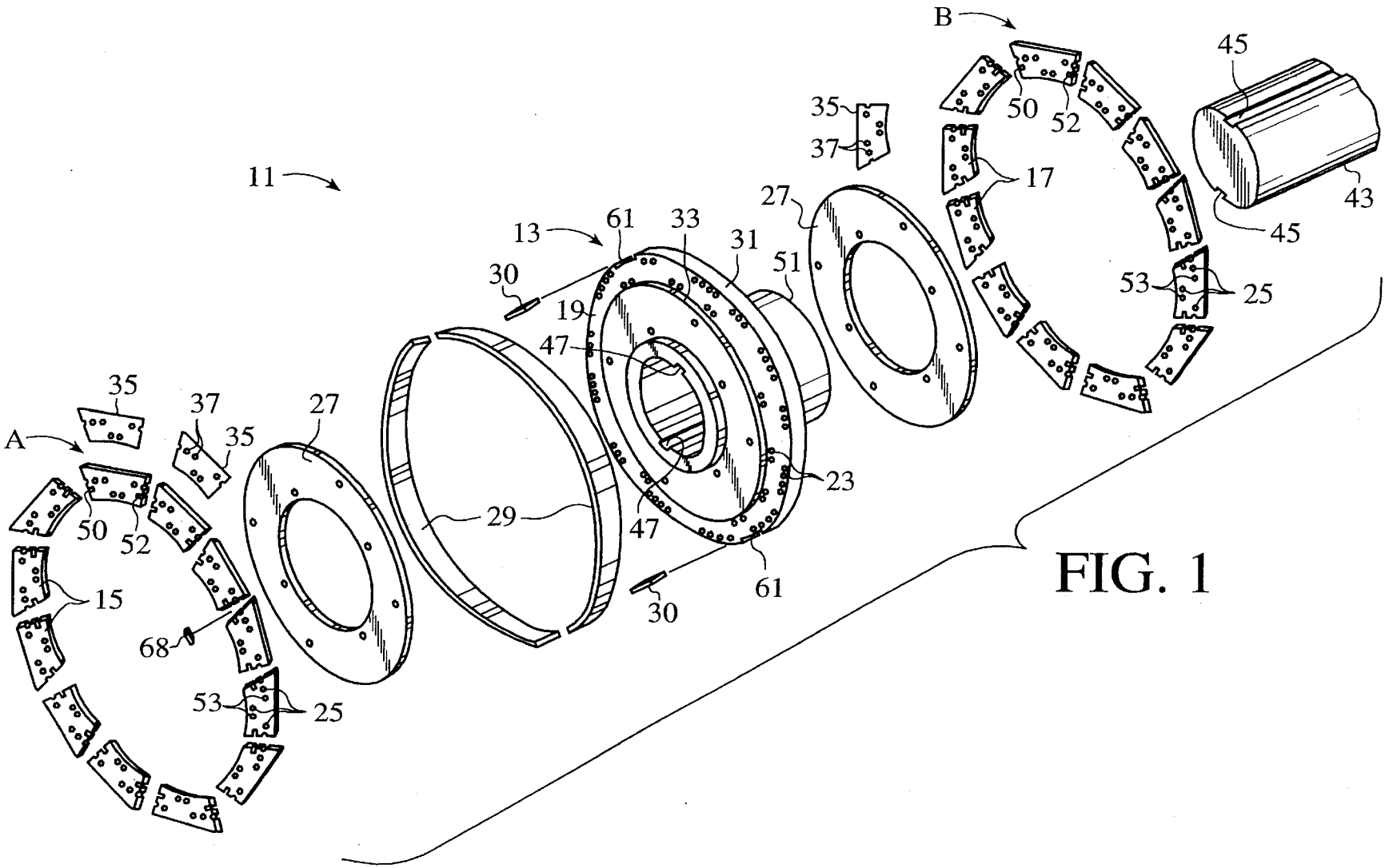
FIG. 1 is an exploded view of the shearing wheel in accord with the present invention.

The present invention, as shown in FIG. 1, is based on the recognition that the relative wear between the surface of a shear knife and side of an annular shearing wheel, which it faces, increases as the thickness of shims disposed therebetween increases. This results in decreasing the operational life of both the shims and the shear knife. It was discovered that the source of this problem was the increased movement of the shear knife, with respect to the annular member, as the shim thickness increased. To overcome this problem, it was determined that the individual shear knives could be stabilized by interlocking them. Specifically, adjacent shear knives were interlocked to provide a solid and stable ring of knives about the shearing wheel.

FIG. 1 shows a shearing wheel 11 including an annular member 13 and two sets A and B of shear knives 15 and 17, respectively. Although shear knives 15 and 17 could be mounted onto the periphery 31 of the annular member 31, it is preferred to have each set of shear knives 15 and 17 mounted to a side face 19 of the annular 10 member 13 by a plurality of bolts 21, shown in FIG. 7. The bolts penetrate bores 23 of the annular member 13 to engage corresponding threaded holes 25 in the shear knives. Also included on each shear knife are rectangular slots 50 and 52, which form a chevron-shaped aperture once the knives are mounted onto the annular member 13. A key 68 is inserted into each chevron-shaped aperture, which is discussed more fully below with respect to FIGS. 2–5.

A support shoulder 33 extends axially outward from the annular member 13. The shear knives 15 and 17 are mounted so that a radially inward surface of each contacts the support shoulder 33. Shims 35 may be used to space apart selected shear knives 15 and 17 from the annular member 13. Each shim 35 has holes 37 for passage of the bolts 21. The shear knives preferably extend axially outward beyond the support shoulder 33 relative to side face 19. Furthermore, a portion of each shear knife extends radially outward beyond the circumferential periphery 31 of the annular member 13 to form a tooth 39 or 41.

The annular member 13 is optionally protected by annular wear plates 27 and circumferential wear plates 29. The annular wear plates 27 are attached to the side faces 19 via bolts or screws 55, shown in FIGS. 6 and 7. These bolts engage with the annular member 13 to removably attach the annular wear plates 27. The circumferential wear plates 29 are held to the outer periphery 31 of the annular member 13 using bolts and connector plates 30, described more fully in relation to FIG. 6. The annular wear plates may extend axially beyond the shear knives.

The shear knives 15 and 17 are made of a chrome alloy tool steel or similar material, while the annular member 13 is made of carbon or alloy steel, such as type 4340. The various parts of shearing wheel 11 are preferably machined before being heat treated. In a preferred embodiment, the shear knives have an axial width of approximately 1 inch and average radial height in the range of 1.5 to 6.0 inches. A portion of each shear knife, the tooth, extends approximately ⅝ inch beyond the abutting adjacent shear knife. The major radial diameter of the wheel as measured from the extending teeth is approximately 25 and ⅝ inches and the minor radial diameter measured from the circumferential coverplate 29 is 23 inches. The materials used to make the shearing wheel 11 are not critical so long as the shear knives are constructed from a hardened, wear resistant material suitable for cutting into discarded tires, appliances and the like.

The shearing wheel 11 is mounted onto a shaft 43. One side of a hub 51 may include a pair of bolts, not shown, to secure the shearing wheel 11 to the shaft 43. The shearing wheel is positioned on the shaft by keyways 45 on the circumference of the shaft 43 and by corresponding keyslots 47 at the inside diameter of the annular member 13. Keys 49 fit between the keyways 45 and keyslots 47.

Figure 2:
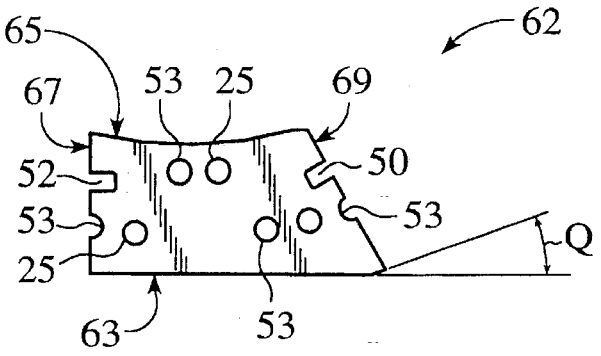
FIG. 2 is a side view of a shear knife used in the shearing wheel of FIG. 1.

Referring also to FIG. 2, a shear knife 62 includes threaded holes 25 and access holes 53. The shear knife 62 has a planar outer surface 63 and a curved inner surface 65, which matches the circular curve of the support shoulder 33. Relative to the planar outer surface 63, the shear knife 15 also includes a right-angled end 67 and an acutely-angled end 69. The angle indicated by Θ of the acutely-angled end 69 is determined by the number of shear knives that make up a set of shear knives. The following equation yields angle:

$$\Theta=90°-(360°/n);n>5$$

where n is the number of shear knives in a set. A minimum of five shear knives is required, and a range of 12 to 24 shear knives per set is preferred; however, it is preferred to use 12 shear knives.

Figure 3:
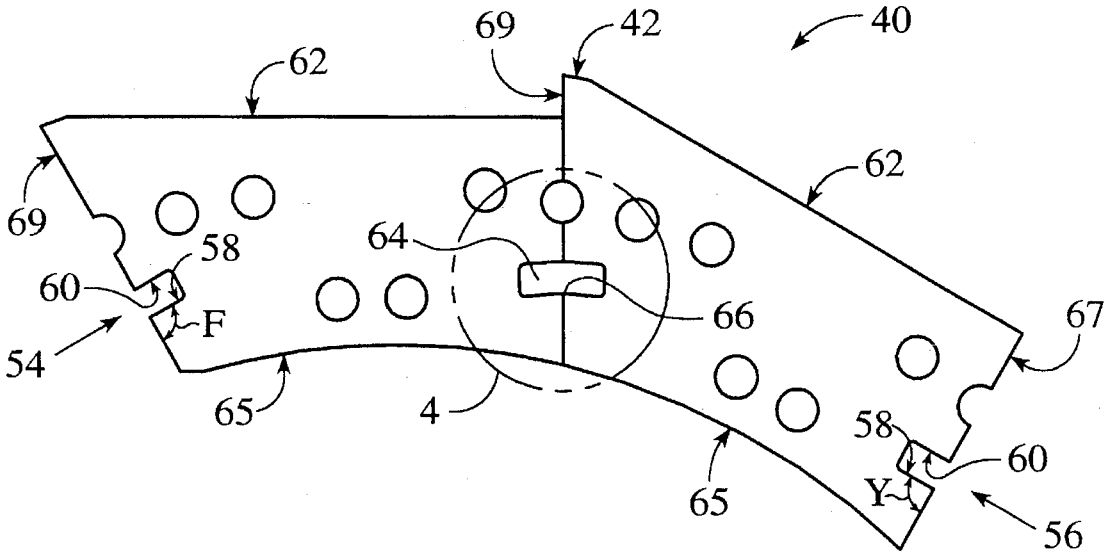
FIG. 3 is a side view of two abutting shear knives used in the shearing wheel of FIG. 1.

Referring also to FIG. 3, it was discovered that individual shear knives 62 move along an axis parallel to the rotational axis of the annular member, during operation. In this manner, a shear knife 62 would rock back-and-forth on the support shoulder 33. This substantially reduced the operational life of the knife 62 and any shims that may be associated with it. To overcome this drawback, each shear knife includes first 50 and second 52 rectangular slots at each end of the knife. The first rectangular slot 50 defines an opening 54 proximate to the acutely-angled end 69 and extends inwardly and downwardly therefrom towards the curved inner surface 65, defining a length. The second rectangular slot 52 defines an orifice 56 proximate to the right-angled end 67 and extends inwardly and downwardly therefrom towards the curved inner surface 65, defining a length. The width of each slot 50 and 52 is typically coextensive with the axial width of the knife, so that the width of the slot extends completely through the knife. The first 50 and second 52 slots each have a planar lower surface 58, proximate to the curved inner surface 65, and a planar upper surface 60 spaced apart from, and parallel to, the lower surface 58. Although not critical, it is preferred that each slot extends inwardly a distance 17/32 inch and with the distance between the upper 58 and lower 60 surfaces being in the range of 0.375–0.377 inch. The lower surface 58 of the first slot 50 defines an angle Φ with respect to the acutely-angled end 69, and the lower surface 58 of the second slot 52 defines an angle ψ with respect to the right-angled end 67. It is preferred that the angles Φ and ψ are equal and in the range of 85–90 degrees, with a preferred angle of 89.5 degrees. A tooth portion 40 is defined by the acutely-angled end 69, the planar outer surface 63 and an oblique surface 42 extending therebetween. The oblique surface 42 substantially reduces the susceptibility of the tooth portion 40 to breakage.

Figure 4:
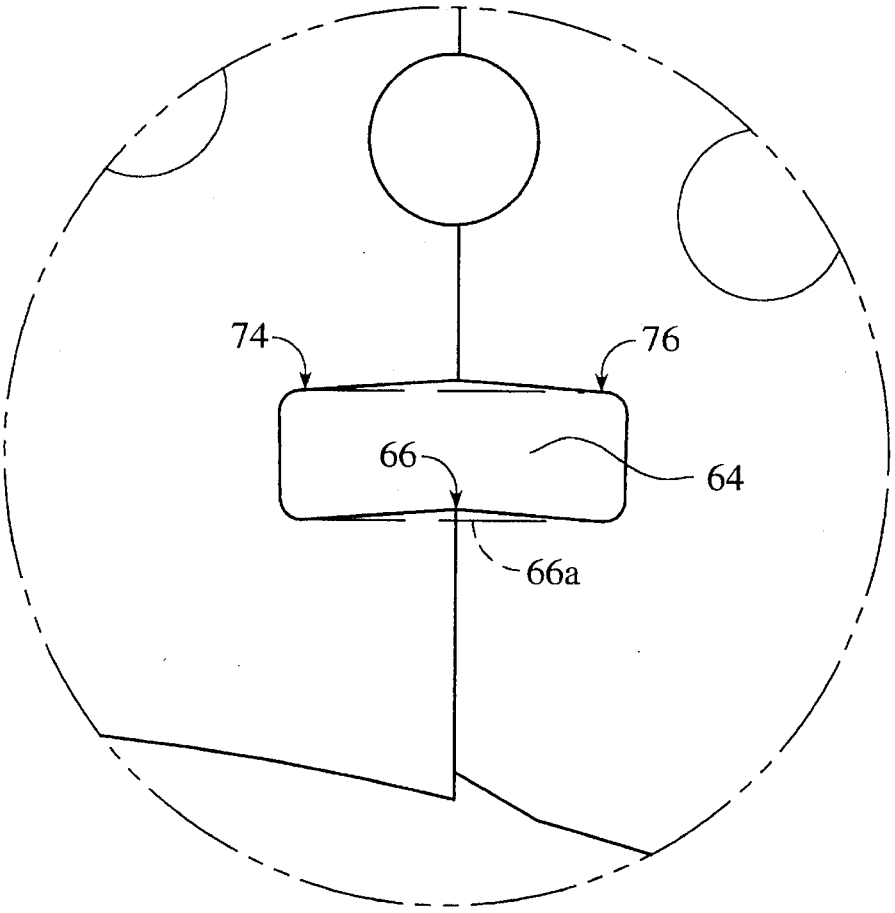
FIG. 4 is a detailed side view of a chevron-shaped aperture defined by the two abutting shear knives shown in FIG. 3.
Figure 5:
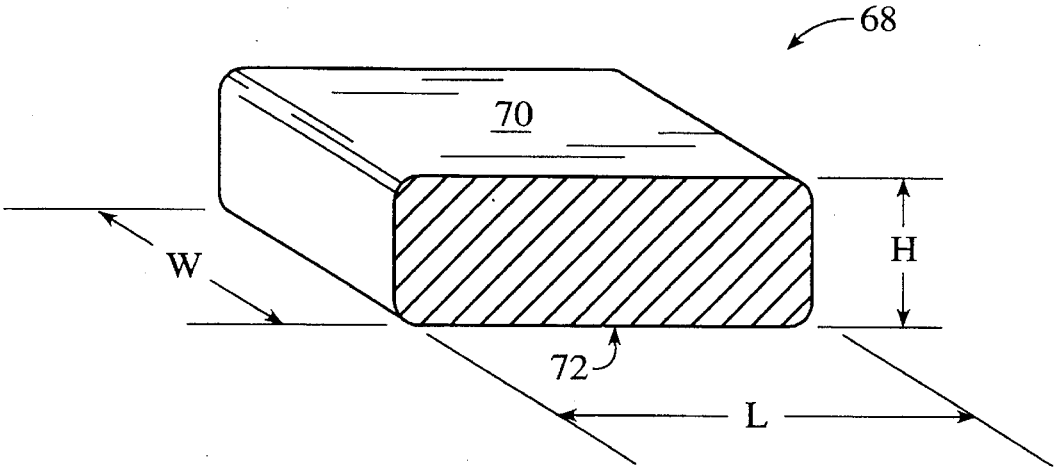
FIG. 5 is a perspective view of a key to fit into the chevron-shaped aperture shown in FIG. 4 and in accord with the present invention.

Referring also to FIGS. 4 and 5, the first and second slots are positioned so that openings 54 and 56 are aligned when the right-angled end 67 and the acutely-angled end 69 of adjacent knives 62 abut one another. In this manner, the first and second slots define a chevron shaped aperture 64. It should be understood that the chevron-shaped aperture 64 is shown in an exaggerated fashion for demonstrative purposes and that figures are not to scale. The lower surface 58 of the abutting first 50 and second 52 slots form the lower surface of the chevron-shaped aperture 64 with an apex 66 positioned at the junction of the right-angled end 67 and the acutely-angled end 69 of the lower surfaces 58. A rectangular key 68 is structured to be received within the chevronshaped aperture 64, to provide a bending force onto the apex, which is directed radially toward the curved inner surface 65.

The key 68 includes upper 70 and lower 72 major surfaces that are typically planar. The upper 70 and lower 72 major surfaces are parallel and spaced apart a distance, defining a height H, equal to the distance between the upper and lower surface of each of the slots. The axial width W is coextensive with the axial width of the slots. The length L is perpendicular to both the axial width and the height and coextensive with the chevron-shaped aperture. After the shear knives 62 are securely fastened to the annular member 13, the key 68 is inserted into the chevron-shaped aperture 64. The major upper surface 70 contacts the upper surface of the chevron-shaped aperture at two regions 74 and 76, each distally positioned on opposites sides of the apex 66. The major lower surface 72 comes into contact with the apex 66. The rigidity of the key 68 deflects the apex 66 toward the inward surface 65 shown by the dotted line **66*a*, with dotted line 66*a* representing the adjoining major lower surface 72 and the downwardly deflected apex 66. In this manner, the key 68 and the chevron-shaped aperture define an interlock key assembly that wedges together the right-angled end 67 and the acutely-angled end 69, as well as forces the radially inward surface 65 against the support shoulder 33, thereby constricting the registered diameter. The registered diameter is defined by a circle formed by curved inner surfaces 65 of the shear knives, laid right angled 67 to acutely angled end 69 along the entire support shoulder 33**.

Shear knife 62 is cut from a planar steel bar and then machined. It is, therefore, necessary to ensure that the key 68 is formed from a compound having sufficient hardness to deflect the apex 66, as discussed above. Typically, the key 68 is formed from segments of cold-rolled-steel. The machining of the shear knife 62 includes forming the curved inner surface 65 in the member. Threaded holes 25 are drilled and tapped, while access holes 53 are drilled into the member. As shown, the right and acutely angled ends contain half of an access hole that coincides with a half hole on an adjacent shear knife, to form a complete access hole 53 when mounted. While a specific layout of threaded and access holes is shown, it will be appreciated that other layouts may be used so long as the holes in the shear knives match up and align with the bores and bolts in the annular member. After machining, the shear knife may be hardened.

Figure 6:
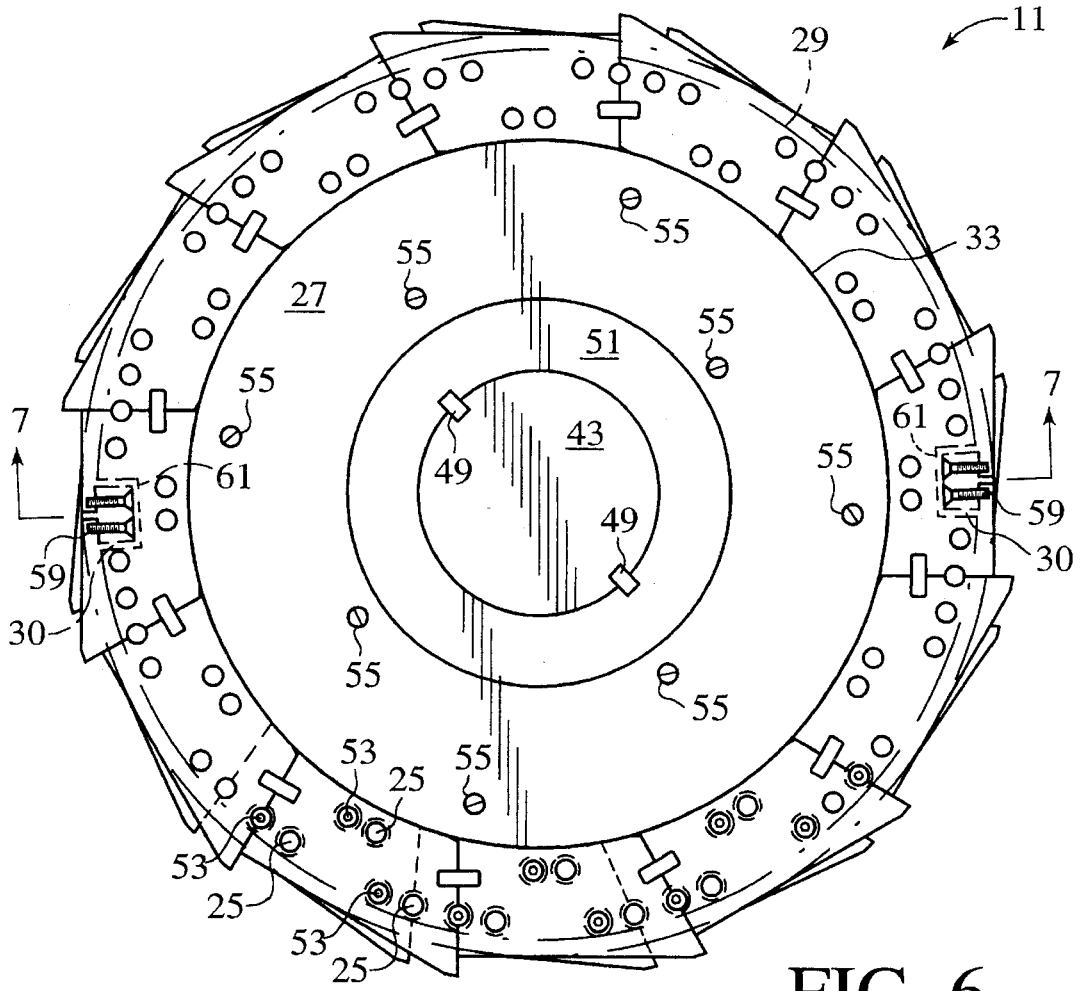
FIG. 6 is a side view of the shearing wheel of FIG. 1.
Figure 7:
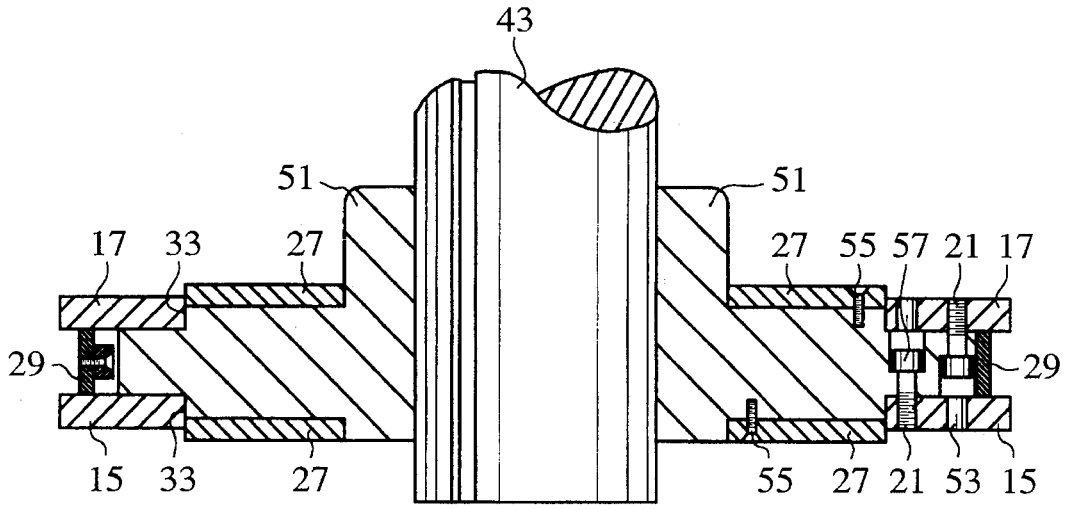
FIG. 7 is a partial cutaway view taken along line 3—3 in FIG. 2.

Referring now to FIGS. 6 and 7, the shearing wheel 11 is mounted on shaft 43 with keys 49 providing torsional transfer of rotation. Moving radially outward is hub 51 and then annular wear plates 27. The inner diameter of the annular wear plates 27 is slightly larger than the outer diameter of the hub 51 so that the annular wear plates fit over the hub. Bolts or screws 55 secure the annular wear plates 27 to a side of the shearing wheel 11. The outer diameter of the annular wear plates 27 coincides with the support shoulders 33. A curved inner surface of each shear knife 15 and 17 contacts one of the support shoulders. Threaded holes 25 are provided in the shear knives, so that bolts 21 on the opposite side of the annular member 13 engage with the threaded holes, to secure the shear knives to the annular member. The shear knives are also provided with access holes 53 through which bolt heads 57 can be accessed for tightening or loosening the bolts 21 which engage with the threaded holes of the shear knives on the opposite side of the annular member 13. The bolt heads 57 have hexagonal recesses for engagement with a hex key tool. Because the diameter of the access holes 53 is less than the diameter of the bolt heads 57, the bolts 21 are confined within the annular member 13 until the shear knife blocking it is removed. In a preferred embodiment, the bores 23 are counterbored ¾ inch to give clearance for the bolt heads 57. The total axial width of the annular member 13 at the bores 23 is 1.000 inches.

The circumferential wear plates 29 are mounted to the outer periphery 31 of the annular member 13 using connector plates 30 and screws 59. Two circumferential wear plates 29 are warm mounted to the annular member 13 so that their ends meet at notches 61 in the annular member. The circumferential wear plates are constructed such that there is a slight gap between the wear plates. A connector plate 30 at each notch 61 is secured onto the ends of the wear plates by screws 59. As the circumferential wear plates 29 cool and contract, a secure fit is achieved.

Figure 8:
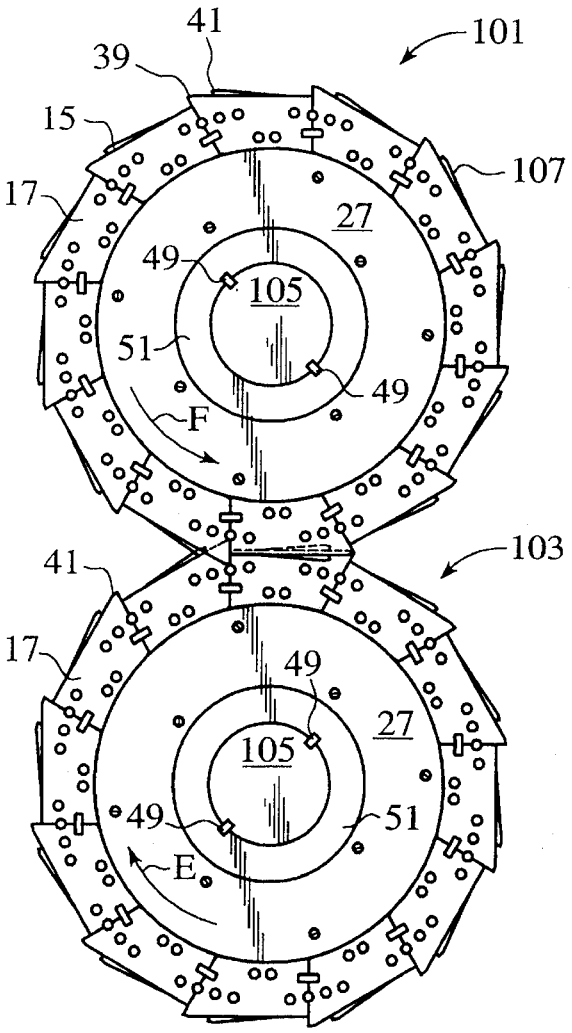
FIG. 8 is a side view of a pair of shearing wheels of FIG. 1 in material shearing cooperative engagement.
Figure 9:
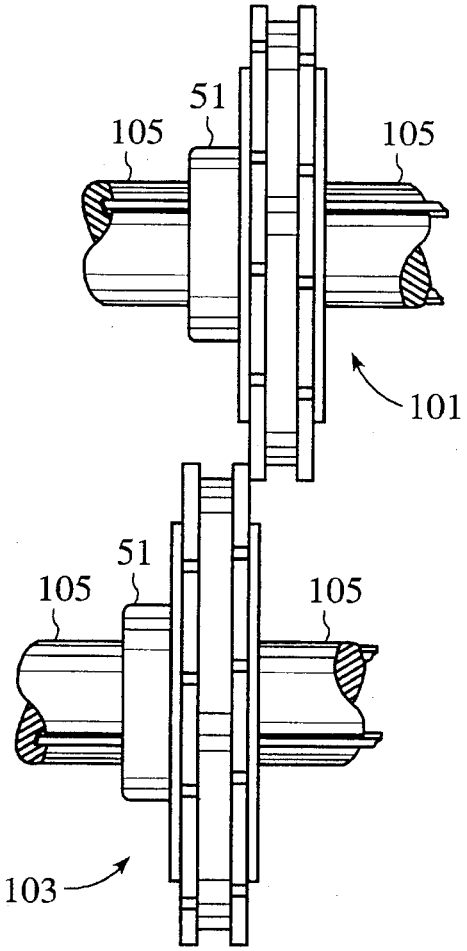
FIG. 9 is a rear view of the shearing wheels of FIG. 8.

In operation, at least two counter-rotating shearing wheels are required in a waste material shredding machine. FIGS. 8 and 9 show a pair of shearing wheels 101 and 103 in counter-rotating shearing engagement. The directions of rotation for shearing wheels 101 and 103 are indicated by arrows E and F, respectively. The shearing wheels 101 and 103 are mounted on parallel shafts 105 by keys 49. Several shearing wheels may be deployed on the shafts 105 for shearing engagement. The shearing wheels 101 and 103 overlap a certain distance and are maintained in a close axial relation. Shear knives 17 of shearing wheel 101 engage with shear knives 17 of shearing wheel 103. Excessive clearance between shearing edges 107 causes the wheels to tear rather than cut the waste material, while too close of a clearance causes premature wear of the shearing edges 107. Preferably, the axial clearance should be 0.002 inch and should not exceed 0.03 inch. Due to the arduous nature of shearing waste material, the shear edges 107 will become dull and the shearing surfaces will become worn. When wear is excessive in a particular shear knife, that shear knife can be removed and its shearing surface can be ground flat, parallel to the mount surface, to restore a sharp shearing edge. Shims may be positioned between the shear knife and the side of the shearing wheel to maintain a proper clearance. The shearing wheels 101 and 103 are further protected by wear plates 27 mounted to the wheels between hub 51 and the shear knives.

The extending teeth 39 and 41 of the shearing wheels 101 and 103 provide the advantage of positively feeding waste material into the shear points of the counter-rotating wheels. Moreover, the teeth can rip the waste material, thereby providing a shearing and ripping action. While shearing wheels with two sets of shear knives have been described and shown in the drawings, a shearing wheel may have only one set of shear knives mounted to a side.

We claim:

1. A rotary shearing wheel comprising:

an annular member for mounting shear knives having a central axis of rotation, a plurality of shear knives removably mounted to the annular member in successive abutting relation, each of the plurality of shear knives having opposed inner and outer major surfaces separated by opposing leading and trailing edges, the leading and trailing edges separating a radially outward facing upper surface and a radially inward facing lower surface, with the leading and trailing edges of successive shear knives mounted with the leading edge of one shear knife abutting the trailing edge of an adjacent shear knife along a length in an offset manner, each shear knife having a tooth portion extending beyond the length, with each abutment of successive shear knives forming a single radially extending tooth; and means for interlocking the plurality of shear knives together, thereby making each of the plurality of shear knives less susceptible to movement.

2. The rotary shear wheel as recited in claim 1 wherein the tooth of each of the plurality of shear knives is defined by the leading edge, the radially outward facing upper surface and an oblique surface extending therebetween, whereby the oblique surface substantially reduces the susceptibility of the tooth to breakage.

3. The rotary shear wheel as recited in claim 2 wherein each of the plurality of shear knives has a plurality of internally threaded bores parallel to the axis of rotation, with the shear knives mounted to the side faces by bolts penetrating the annular member for engagement with the internally threaded bores.

4. The rotary shear wheel as recited in claim 2 wherein each of the plurality of shear knives has a plurality of internally threaded bores perpendicular to the axis of rotation, with the shear knives mounted to the periphery of the annular member for engagement with the internally threaded bores.

5. The rotary shearing wheel as recited in claim 1 wherein the interlocking means includes a first and a second rectangular slot each of which has bifurcated upper and lower surfaces, with the first slot defining an opening proximate to the leading edge and extending inwardly and downwardly therefrom towards the radially inward facing surface of each of the plurality of shear knives, and the second slot defining an orifice proximate to the trailing edge and extending inwardly and downwardly therefrom towards the radially inward facing surface of each of the plurality of shear knives.

6. The rotary shearing wheel as recited in claim 5 wherein the interlocking means includes a plurality of keys to insert into a plurality of chevron-shaped apertures to provide a bending force radially downward toward the rotation axis, with each of the plurality of chevron-shaped apertures defined by an abutment of a first slot with a second slot of successive shear knives with the bifurcated upper surfaces of the first and second slots defining the upper surface of the chevron-shaped aperture and the bifurcated lower surfaces of the first and second slots defining the lower surface of the chevron-shaped aperture, whereby the key provides a bending force onto an apex of the lower surface of the chevron-shaped aperture.

7. The rotary shearing wheel as recited in claim 6 wherein the leading and trailing edges of each of the plurality of shear knives are substantially planar and the bifurcated lower surface of the first slot extends downwardly towards the radially inward facing surface at an angle $\Phi$ with respect to the leading edge and the bifurcated lower surface of the second slot extends downwardly towards the radially inward facing surface at an angle $\psi$ with respect to the trailing edge, wherein the angles $\Phi$ and $\psi$ are within the range of 85 to 90 degrees.

8. A rotary shearing wheel comprising:

an annular member having a central axis of rotation and opposed first and second side faces, with the first side face having a mounting region;

a plurality of shear knives removably mounted to the mounting region in successive abutting relation, each of the plurality of shear knives having opposed inner and outer major surfaces separated by opposing leading and trailing edges, the leading and trailing edges separating a radially outward facing upper surface and a radially inward facing lower surface, the inner major surface mounted facing the first side face, with the leading and trailing edges of successive shear knives mounted with the leading edge of one shear knife abutting the trailing edge of an adjacent shear knife along a length in an offset manner, each of the plurality of shear knives having a tooth portion extending beyond the length, with each abutment of successive shear knives forming a single radially extending tooth; and means for providing a bending force radially towards the axis of rotation, thereby making each of the plurality of shear knives less susceptible to movement independent of a rotation of the shearing wheel.

9. The rotary shearing wheel as recited in claim 8 further including a second plurality of shear knives, substantially similar to the first plurality of shearing blades, removably mounted to a mounting region of the second side face in successive abutting relation, with a tooth portion of each of the second plurality of shearing blades extending beyond the length in like manner to the first plurality of shear knives, wherein the tooth portion of each of the shear knives of the first and second plurality is defined by the leading edge, the radially outward facing upper surface and an oblique surface extending therebetween, whereby the oblique surface substantially reduces the susceptibility of the tooth to breakage.

10. The rotary shearing wheel as recited in claim 9 wherein each of the first and second side faces have an axially outward extending support shoulder in contacting support relation with the lower surface of each of the shear knives of the first and second plurality, respectively with the inward facing surfaces of the first plurality blades abutting the entire surface of the support shoulder associated with the first side face, defining a first registered diameter therebetween, and the inward facing surfaces of the second plurality blades abutting the entire surface of the support shoulder associated with the second side face, defining a second registered diameter therebetween.

11. The rotary shearing wheel as recited in claim 10 wherein the providing means includes a first and a second rectangular slot each of which has bifurcated upper and lower surfaces, with the first slot defining an opening proximate to the leading edge and extending inwardly and downwardly therefrom towards the radially inward facing surface of each of the shear knives of the first and second plurality, and the second slot defining an orifice proximate to the trailing edge and extending inwardly and downwardly therefrom towards the radially inward facing surface of each of the shear knives of the first and second plurality.

12. The rotary shearing wheel as recited in claim 11 wherein the providing means includes a plurality of keys to insert into a plurality of chevron-shaped apertures to provide, with each of the plurality of chevron-shaped apertures defined by an abutment of a first slot with a second slot of successive shear knives with the bifurcated upper surfaces of the first and second slots defining the upper surface of the chevron-shaped aperture and the bifurcated lower surfaces of the first and second slots defining the lower surface of the chevron-shaped aperture, whereby the key provides the bending force onto an apex of the lower surface, wedging adjacent shear knives together and constricting the registered diameter.

13. The rotary shearing wheel as recited in claim 12 wherein the leading and trailing edges of each of the plurality of shear knives are substantially planar and the bifurcated lower surface of the first slot extends downwardly towards the radially inward facing surface at an angle $\Phi$ with respect to the leading edge and the bifurcated lower surface of the second slot extends downwardly towards the radially inward facing surface at an angle $\psi$ with respect to the trailing edge, wherein the angles $\Phi$ and $\psi$ are within the range of 85 to 90 degrees.

14. The rotary shearing wheel as recited in claim 13 including a shim member disposed between each of said shearing blades of the first and second plurality and the first and second side faces, respectively.

15. The rotary shearing wheel as recited in claim 14 wherein the support surface is annular in configuration having a diameter substantially less than the diameter of the annular member.

16. The rotary shearing wheel as recited in claim 15 wherein the axial extent of each of the shear knives of the first and second plurality exceeds the axial extent of the support shoulder.

17. A rotary shearing apparatus having demountable resharpenable shear knives of the type having at least two shearing wheels, including a first wheel on a first shaft and a second wheel mounted on a second shaft parallel to the first shaft, the first and second shafts being spaced apart such that the first and second wheels have thicknesses bringing the wheels into material shearing relation, the improvement comprising:

a pair of adjacent wheels, each having an annular member having circumferential surface, a central axis of rotation and opposed first and second side faces separated by an outer rim, with the first side face having a mounting region located proximate to the outer rim, the mounting region including a support shoulder with a surface concentric and parallel to the circumferential surface, a plurality of shear knives removably mounted to the mounting region in successive abutting relation, each of the plurality of shear knives having opposed inner and outer major surfaces separated by opposed leading and trailing edges, the leading and trailing edges separating a radially outward facing upper surface and a radially inward facing lower surface, the inward facing surfaces of the plurality of shear knives abutting the entire surface of the support shoulder, defining a registered diameter therebetween with the inner major surface of each of the plurality of shear knives mounted facing the first side face, and the leading and trailing edges of successive shear knives mounted with the leading edge of one shear knife abutting the trailing edge of an adjacent shear knife along a length in an offset manner, each of the plurality of shear knives having a tooth portion extending beyond the outer rim, with each abutment of successive shear knives forming a single radially extending tooth;

shim means for adjusting the spacing between each of the shear knives and an adjacent wheel, maintaining a material shearing thickness between the adjacent wheels, the shim means being disposed between the shearing blade and the mounting region of the annular member; and means for constricting the registered diameter, thereby preventing movement of both the shear knife and the shim means, independent of a rotation of the shearing wheel.

18. The rotary shearing wheel as recited in claim 17 wherein the constricting means includes a first and a second rectangular slot each of which has bifurcated upper and lower surfaces, with the first slot defining an opening proximate to the leading edge and extending inwardly and downwardly therefrom towards the radially inward facing surface of each of the plurality of shear knives, and the second slot defining an orifice proximate to the trailing edge and extending inwardly and downwardly therefrom towards the radially inward facing surface of each of the plurality of shear knives.

19. The rotary shearing wheel as recited in claim 18 wherein the constricting means includes a plurality of keys to insert into a plurality of chevron-shaped apertures to provide, with each of the plurality of chevron-shaped apertures defined by an abutment of a first slot with a second slot of successive shear knives with the bifurcated upper surfaces of the first and second slots defining the upper surface of the chevron-shaped aperture and the bifurcated lower surfaces of the first and second slots defining the lower surface of the chevron-shaped aperture, whereby the key provides the bending force onto an apex of the lower surface, wedging adjacent shear knives together and constricting the registered diameter.

20. The apparatus as recited in claim 19 wherein the side face of the annular member is a first side face, the annular member having a second side face with an axially outward extending support shoulder and mounting region from mount a second plurality of shear knives thereto.

* * * * *